US009373906B2

(12) United States Patent
Yamazaki et al.

(10) Patent No.: US 9,373,906 B2
(45) Date of Patent: Jun. 21, 2016

(54) COMMUNICATION MODULE AND COMMUNICATION MODULE CONNECTOR

(71) Applicant: Hitachi Metals, Ltd., Minato-ku, Tokyo (JP)

(72) Inventors: Kinya Yamazaki, Hitachi (JP); Yoshinori Sunaga, Hitachinaka (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/672,330

(22) Filed: Mar. 30, 2015

(65) Prior Publication Data

US 2015/0288087 A1 Oct. 8, 2015

(30) Foreign Application Priority Data

Apr. 3, 2014 (JP) ..... 2014-076878

(51) Int. Cl.
*H01R 12/72* (2011.01)
*H01R 13/56* (2006.01)
*H01R 12/71* (2011.01)

(52) U.S. Cl.
CPC ..... *H01R 12/722* (2013.01); *H01R 13/56* (2013.01); *H01R 12/716* (2013.01); *H01R 12/721* (2013.01)

(58) Field of Classification Search
CPC .... H01R 12/721; H01R 12/722; H01R 13/56; H05K 1/117
See application file for complete search history.

(56) References Cited

U.S. PATENT DOCUMENTS

| | | | | |
|---|---|---|---|---|
| 7,160,141 | B2 * | 1/2007 | Marshall et al. | 439/451 |
| 7,514,629 | B2 * | 4/2009 | Sasaki et al. | 174/50 |
| 7,672,141 | B2 * | 3/2010 | Middleton et al. | 361/785 |
| 8,018,729 | B2 * | 9/2011 | Skinner | 361/760 |
| 8,264,842 | B2 * | 9/2012 | Chen et al. | 361/729 |
| 2004/0253849 | A1 * | 12/2004 | Kuribayashi et al. | 439/76.1 |
| 2006/0232922 | A1 * | 10/2006 | Tong | 361/685 |

FOREIGN PATENT DOCUMENTS

JP 2007-134150 A 5/2007

* cited by examiner

*Primary Examiner* — Briggitte R Hammond
(74) *Attorney, Agent, or Firm* — Crowell & Moring LLP

(57) ABSTRACT

To suppress degradation of signals exchanged between the semiconductor chip and each of the communication modules while a large number of communication modules are mounted near a semiconductor chip at a high density. A connector includes a plug connector provided in a communication module and a receptacle connector provided in a motherboard to which the connection module is connected. The plug connector has an inserting convex portion that is connected to a module substrate included in the communication module. The receptacle connector has an inserting concave portion into which the inserting convex portion is inserted. A plurality of first connection terminals are arranged in two outer side surfaces in parallel with each other, of the inserting convex portion. A plurality of second connection terminals in contact with the first connection terminals are arranged in two inner side surfaces in parallel with each other, of the inserting concave portion. A thickness of the module substrate is one half or less of a thickness of the inserting convex portion.

6 Claims, 7 Drawing Sheets

COMMUNICATION MODULE AND COMMUNICATION MODULE CONNECTOR

CROSS-REFERENCE TO RELATED APPLICATION

The present application claims priority from Japanese Patent Application No. 2014-076878 filed on Apr. 3, 2014, the content of which is hereby incorporated by reference into this application.

TECHNICAL FIELD OF THE INVENTION

The present invention relates to a communication module and a communication module connector.

BACKGROUND OF THE INVENTION

In a server or network equipment, etc., a semiconductor chip (IC chip) and a plurality of communication modules are mounted on a substrate, which is generally called "mother board". Here, the processing ability of the semiconductor chip (IC chip) has been rapidly improved along with thinning of the semiconductor manufacturing process, and thus speed enhancement of digital signals to be inputted and outputted to and from the semiconductor chip has been progressed year by year along with the improvement of the processing ability of the semiconductor chip. That is, the speed of digital signals exchanged between the semiconductor chip and IC modules has been improved year by year, where the speed of digital signals to be inputted and outputted to and from a semiconductor chip and communication modules of the next generation is expected to be 25 Gbit/sec, and the speed of digital signals to be inputted and outputted to and from a semiconductor chip and communication modules of the second next generation is expected to be 50 Gbit/sec.

However, the transmission loss during electric transmission of high-speed digital signals is large. In other words, signal degradation of high-speed digital signals during transmission is severe. For example, in a case of high-speed digital signals of 25 Gbit/sec, loss of about 0.8 dB/cm is generated on electric wirings that are formed on a general printed board. Even on electric wirings formed on a high-grade printed board for high-speed signals, loss of about 0.4 dB/cm is generated.

SUMMARY OF THE INVENTION

In such a situation, it has been required to suppress degradation of signals exchanged between the semiconductor chip and each of the communication modules while a large number of communication modules are mounted near a semiconductor chip at a high density.

However, a LGA structure (Land Grid Array) conventionally used as a mounting structure of communication modules is high-cost and the usability is not good (not easy to carry out attachment and detachment of the communication module).

An object of the present invention is to suppress degradation of signals exchanged between the semiconductor chip and each of the communication modules while a large number of communication modules are mounted near a semiconductor chip at a high density.

A communication module connector according to the present invention includes a plug connector provided in a communication module, and a receptacle connector provided in a substrate to which the communication module is connected. The plug connector has an inserting convex portion that is connected to a module substrate included in the communication module. The receptacle connector has an inserting concave portion into which the inserting convex portion is inserted. A plurality of first connection terminals are arranged in two outer side surfaces in parallel with each other, of the inserting convex portion. A plurality of second connection terminals in contact with the first connection terminals are arranged in two inner side surfaces in parallel with each other, of the inserting concave portion. In addition, a thickness of the module substrate is one quarter or more and three quarters or less of a thickness of the inserting convex portion.

A communication module of the present invention includes: a frame in which a module substrate is accommodated; and a plug connector connected to a receptacle connector provided in the substrate. The plug connector has an inserting convex portion that is inserted into an inserting concave portion included in the receptacle connector, the inserting convex portion connected to the module substrate. A plurality of first connection terminals are arranged in two outer side surfaces of the inserting convex portion, the two outer side surfaces in parallel with each other, the plurality of first connection terminals in contact with a plurality of second connection terminals which are arranged in two inner side surfaces of the inserting concave portion, the two inner side surfaces in parallel with each other. A thickness of the module substrate is one quarter or more and three quarters or less of a thickness of the inserting convex portion.

In an aspect of the present invention, a thickness of the module substrate is 0.25 mm or more and 0.75 mm or less.

In another aspect of the present invention, a conductive path that forms a part of a signal transmission path is provided in the module substrate. A length of the conductive path in a thickness direction of the module substrate is one quarter or more and three quarters or less of a thickness of the inserting convex portion.

According to the present invention, it is possible to suppress degradation of signals exchanged between a semiconductor chip and each communication module while the plurality of communication modules are mounted near the semiconductor chip at a high density.

BRIEF DESCRIPTIONS OF THE DRAWINGS

DESCRIPTIONS OF THE PREFERRED EMBODIMENTS

Figure 1:
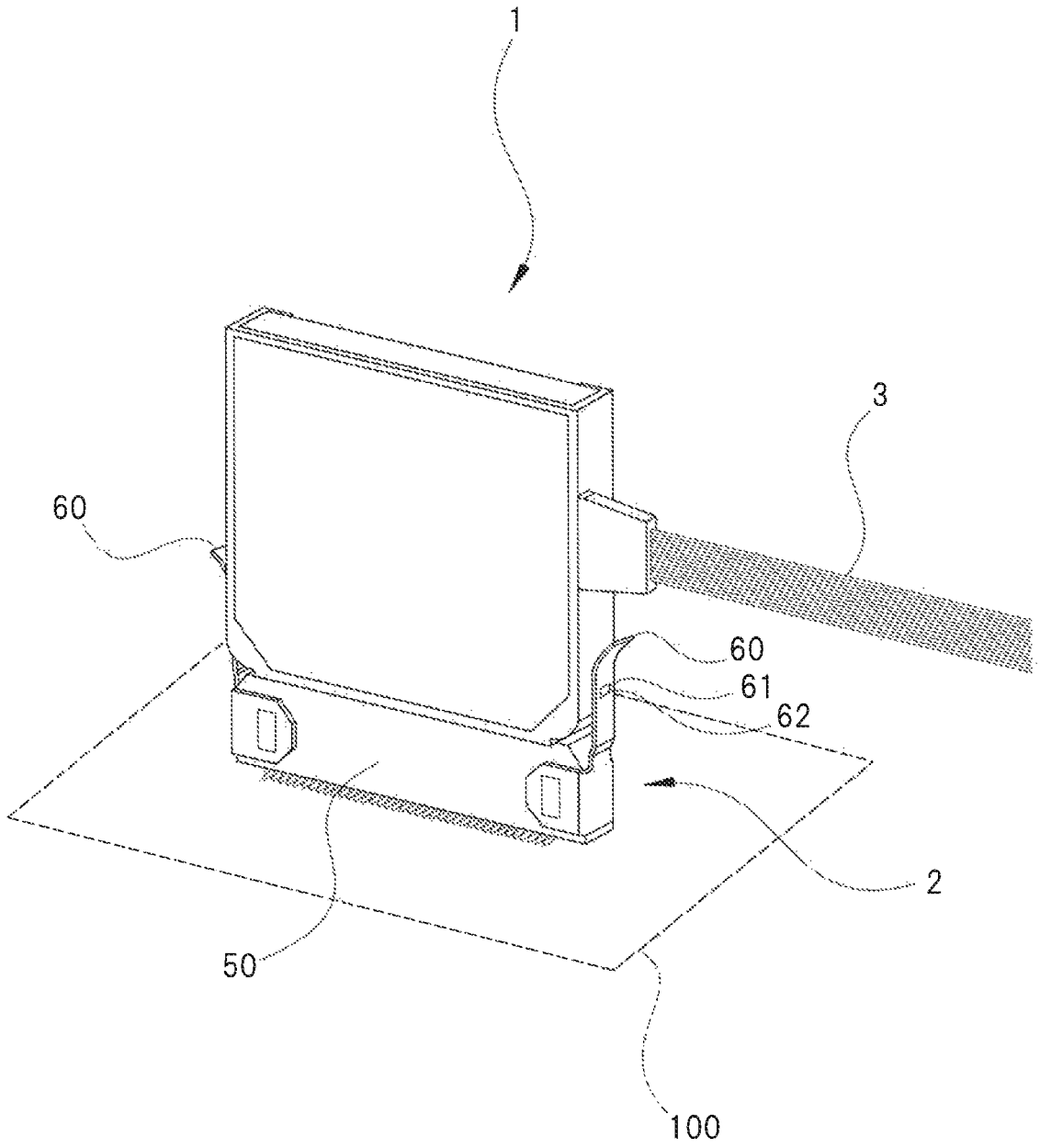
FIG. 1 is a perspective view illustrating an example of a communication module connected to a motherboard via a connector in which the present invention is used.

Hereinafter, an example of an embodiment of the present invention will be described in detail with reference to the accompanying drawings. A communication module 1 illustrated in FIG. 1 is connected to a substrate (motherboard 100) via a communication module connector 2. Although not illustrated, a semiconductor chip is mounted on the motherboard 100. The communication module 1 connected to the motherboard 100 is connected to the semiconductor chip via electric wirings formed on the motherboard 100. In addition, although a single communication module 1 is illustrated in FIG. 1, in practice, a plurality of communication modules identical to the communication module 1 are arranged around the semiconductor chip and each of the communication modules is connected to the motherboard 100 via the communication module connector 2. In the following descriptions, the communication module connector 2 will be abbreviated as "connector 2".

Figure 2:
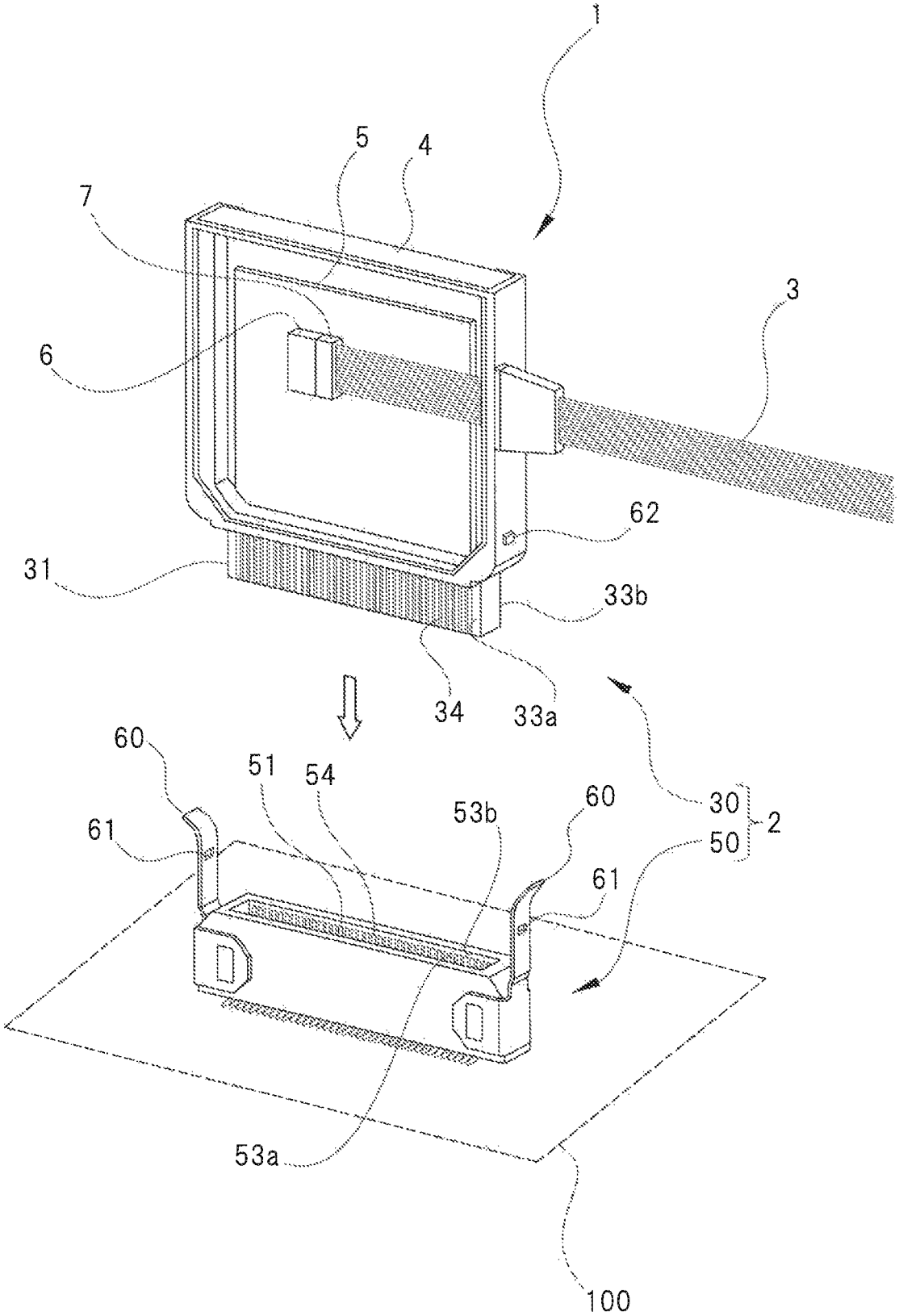
FIG. 2 is a perspective view illustrating structures of the connection module and the connector illustrated in FIG. 1.

As illustrated in FIG. 2, the connector 2 which connects the communication module 1 and the motherboard 100 includes a plug connector 30 provided in the communication module 1 and a receptacle connector 50 provided in the motherboard 100. The plug connector 30 has an inserting convex portion 31, while the receptacle connector 50 has an inserting concave portion 51. The inserting convex portion 31 of the plug connector 30 is inserted into the inserting concave portion 51 of the receptacle connector 50 along the arrow's direction (inserting direction) in the figure. As the inserting convex portion is inserted into the inserting concave portion 51, connection terminals provided in both of them come into contact with each other. In this manner, the communication module 1 and the motherboard 100 are electrically connected via the connector 2, thereby enabling transmission and reception (input and output) of signals between the communication module 1 and the semiconductor chip mounted on the motherboard 100. Details of the plug connector 30 and the receptacle connector 50 will be described later.

As illustrated in FIG. 2, the communication module 1 includes a frame 4 to which an optical fiber (fiber ribbon) 3 is connected, and a module substrate 5 accommodated in the frame 4. Although not illustrated, a photoelectric conversion portion is provided to the module substrate 5. More specifically, a light-emitting element and a drive IC for driving the light-emitting element are mounted on the module substrate 5, and a light-receiving element and an amplification IC for amplifying signals outputted from the light-receiving element are mounted thereon. In addition, in the module substrate 5, a lens block 6 for optically coupling the light-emitting element with the light-receiving element and the optical fiber 3. An MT (mechanically transferable) connector 7 is attached to a distal end of the optical fiber 3 pulled into the frame 4 and the MT connector 7 is connected to the lens block 6. More specifically, a distal end surface of the MT connector 7 is abutted on an abutment surface of the lens block 6. Further, a pair of guide pins are protruded from the abutment surface of the lens block 6, and the guide pins are inserted into guide holes formed in the distal end surface of the MT connector 7. Note that, in the present embodiment, a VCSEL (vertical cavity surface emitting laser) is used as a light-emitting element, and a PD (photodiode) is used as a light-receiving element. However, the light-emitting element and the light-receiving element are not limited to specific ones.

Figure 3A:
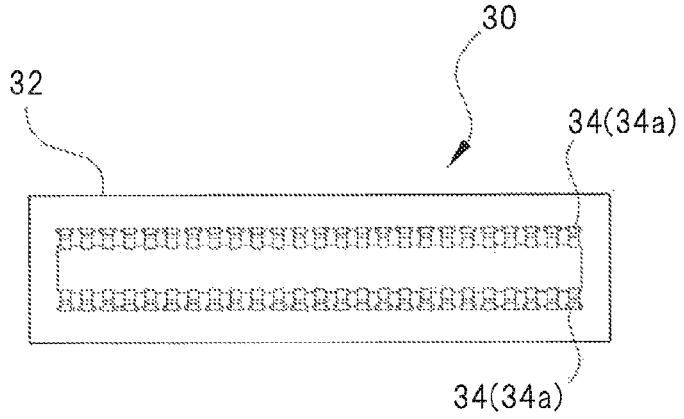
FIG. 3A is a plan view of a plug connector.
Figure 3B:
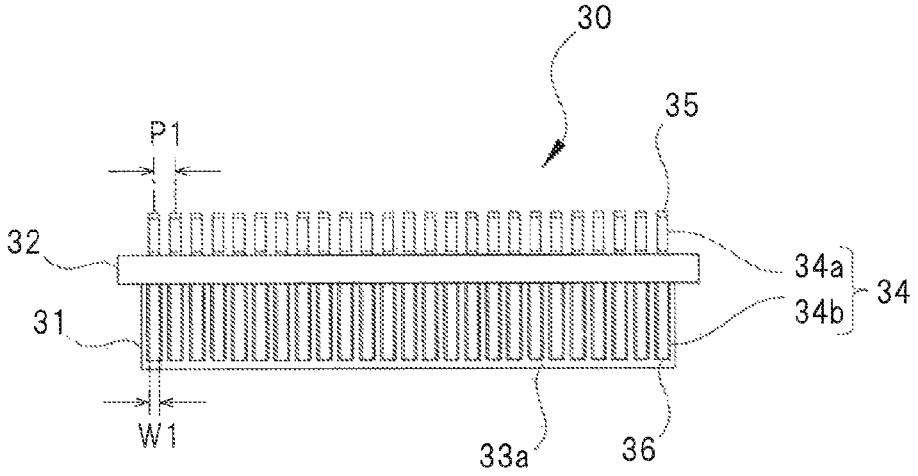
FIG. 3B is a front view of the plug connector.
Figure 3C:
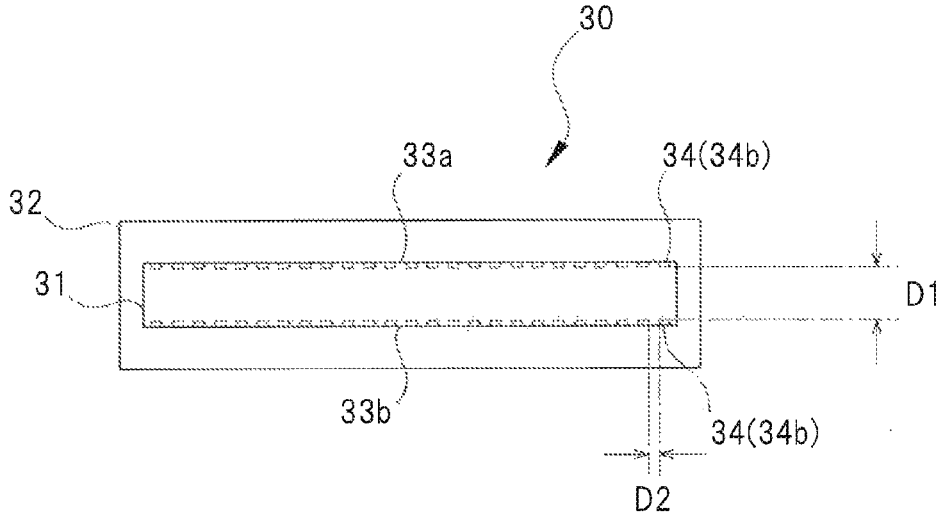
FIG. 3C is a bottom view of the plug connector.

As illustrated in FIGS. 3A to 3C, the plug connector 30 includes the inserting convex portion 31 in a block-like shape and a flange portion 32 in a plate-like shape provided in an upper portion of the inserting convex portion 31. The flange portion 32 is stretched around the inserting convex portion 31. In other words, the inserting convex portion 31 is extended downwards from the flange portion 32.

The inserting convex portion 31 and the flange portion 32 are integrally formed using a dielectric (synthetic resin in the present embodiment). As illustrated in FIG. 2, the inserting convex portion 31 has two outer side surfaces 33*a* and 33*b* in parallel with each other. As illustrated in FIGS. 3B and 3C, in the outer side surfaces 33*a* and 33*b*, a plurality of first connection terminals 34 are arranged to be in parallel with each other along a longitudinal direction of such outer side surfaces 33*a* and 33*b*. In other words, in each of the outer side surfaces 33*a* and 33*b* of the inserting convex portion 31, a terminal row including the plurality of first connection terminals 34 is formed. In the following description, the outer side surface 33*a* that is one side of the inserting convex portion 31 illustrated in FIG. 3C may be called "right outer side surface 33*a*", and the outer side surface 33*b* that is the other side of the inserting convex portion 31 may be called "left outer side surface 33*b*". In addition, a terminal row formed in the right outer side surface 33*a* may be called "right-side first terminal row", and a terminal row formed in the left outer side surface 33*b* may be called "left-side first terminal row".

As illustrated in FIG. 3B, each of the first connection terminals 34 forming the right-side first terminal row and the left-side first terminal row extends along the direction of inserting the inserting convex portion 31 into the inserting concave portion 51 (the arrow's direction in FIG. 2) and reaches the top and bottom of the flange portion 32 across the flange portion 32. In the following description, an "inserting direction" refers to the direction of inserting the inserting convex portion 31 into the inserting concave portion 51 (the arrow's direction in FIG. 2) unless otherwise noted.

A part of each of the first connection terminals 34 in the longitudinal direction extending along the inserting direction is protruded upwards from the flange portion 32. In contrast, the other part of each of the first connection terminal 34 in the longitudinal direction is protruded downwards from the flange portion 32 and exposed above the outer side surfaces 33*a* and 33*b*. Thus, while an end portion 35 of the top side of the inserting direction of the first connection terminal 34 is positioned above the flange portion 32, an end portion 36 of the bottom side of the inserting direction of the first connection terminal 34 is positioned below the flange portion 32. In the following description, the part of the first connection terminal 34 in the longitudinal direction, which is protruded upwards from the flange portion 32, may be called "upper portion 34*a*", and the other part of the first connection terminal 34 in the longitudinal direction, which is protruded downwards from the flange portion 32, may be called "lower portion 34*b*".

Figure 5:
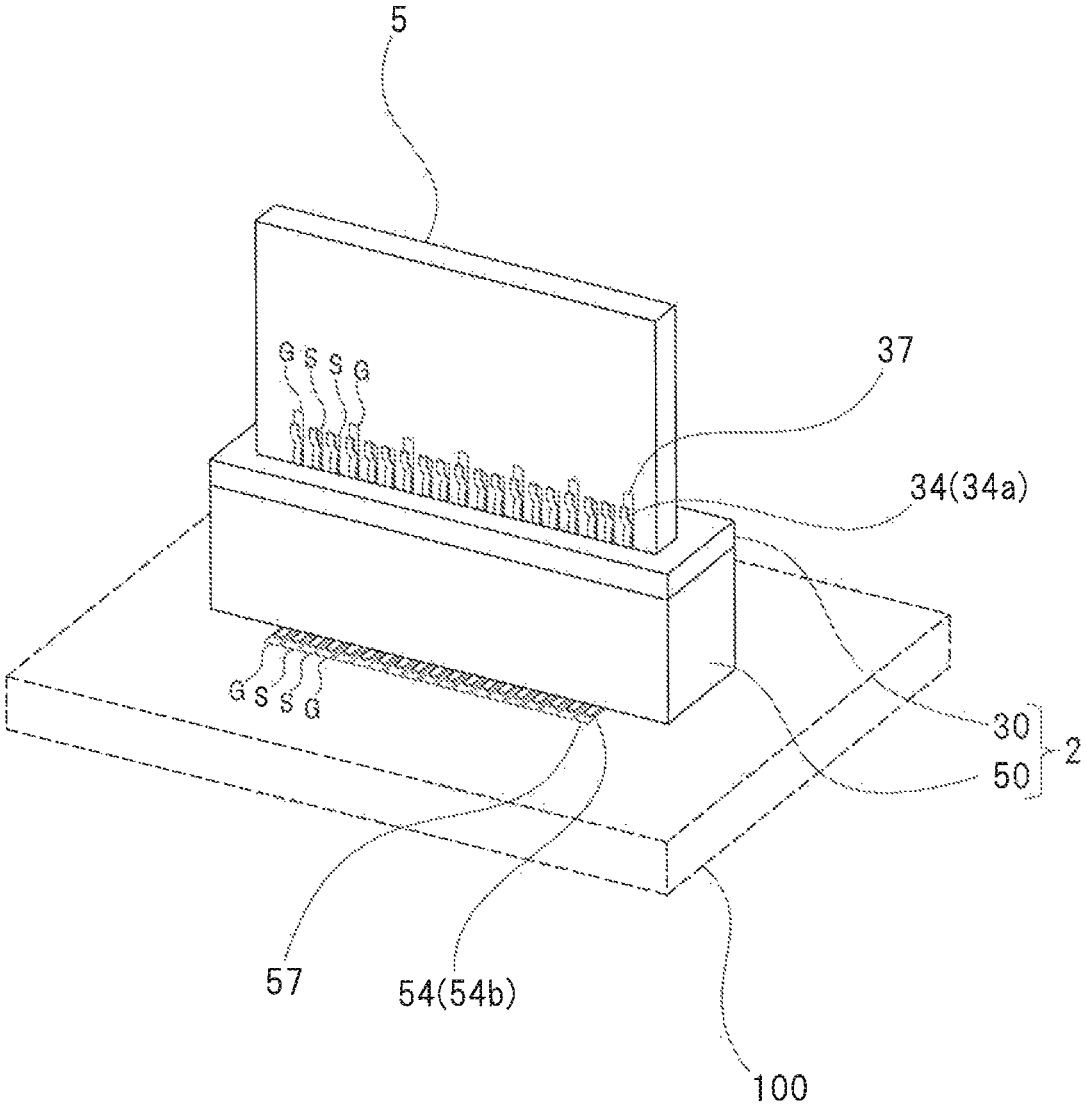
FIG. 5 is a perspective view schematically illustrating a connection state of the plug connector and the receptacle connector.
Figure 6:
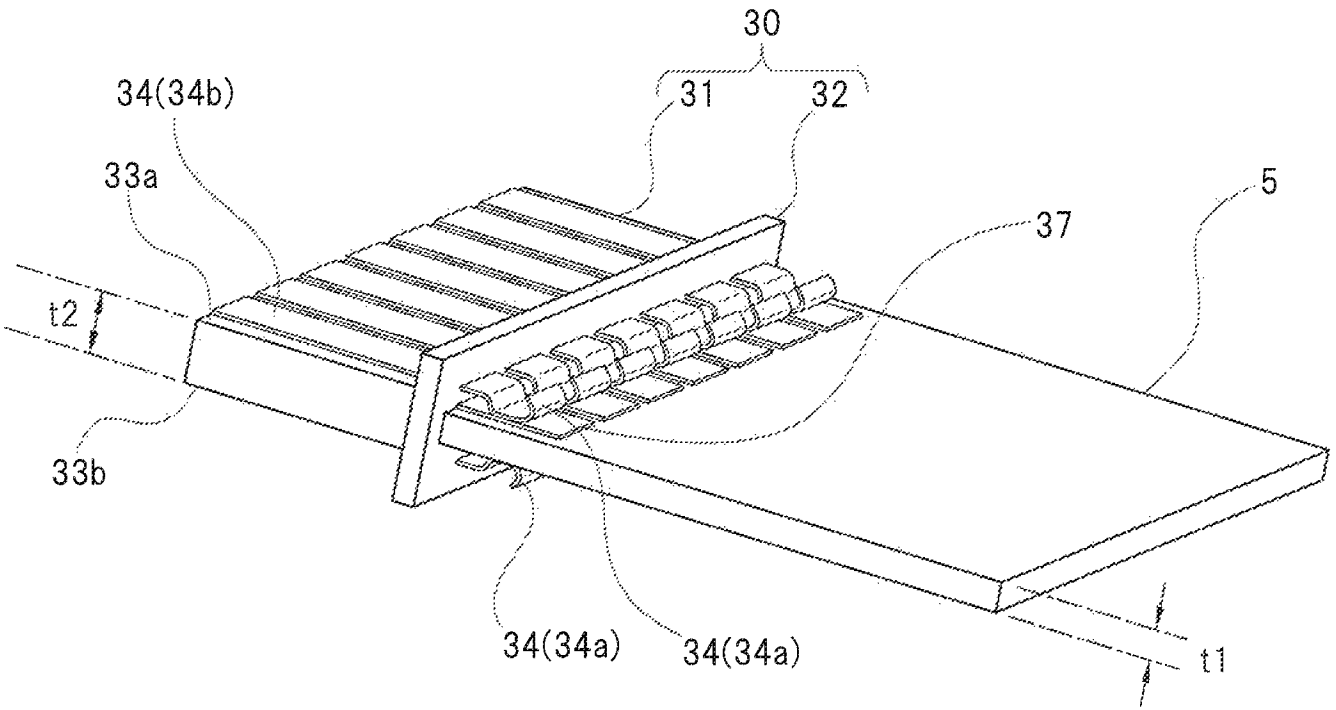
FIG. 6 is a perspective view schematically illustrating a connection state of the plug connector and the module substrate.

As illustrated in FIG. 3A, the upper portion 34*a* of each of the first connection terminals 34 forming the right-side first terminal row and the upper portion 34*a* of each of the first connection terminals 34 forming the left-side first terminal row form a pair facing each other interposing a predetermined interval. As illustrated in FIGS. 5 and 6, a verge of the module substrate 5 is inserted into a gap between the upper portion 34*a* of the right-side first terminal row and the upper portion 34*a* of the left-side first terminal row. Connection pads 37 are formed in both surfaces of the verge of the module substrate 5, respectively, thereby contacting and electrically conducting a certain connection pad 37 and an upper portion 34*a* of a certain first connection terminal 34.

Here, the gap between the upper portion 34*a* of the right-side first terminal row and the upper portion 34*a* of the left-side first terminal row before the verge of the module substrate 5 is inserted thereinto is slightly smaller than a thickness of the module substrate 5. In addition, the upper portion 34*a* of each of the first connection terminals 34 is bended and elastic. Thus, when the verge of the module substrate 5 is inserted into the gap between the upper portion 34*a* of the right-side first terminal row and the upper portion 34*a* of the left-side first terminal row, the upper portion 34*a* of the right-side first terminal row and the upper portion 34*a* of the left-side first terminal row are elastically deformed so as to be separated from each other. As a result, the upper portion 34*a* of the right-side first terminal row and the upper portion 34*a* of the left-side first terminal row are attached firmly to the connection pad 37 by means of the elastic resilience. Normally, the connection pad 37 and the upper portion 34*a* of the right-side first terminal row and the upper portion 34*a* of the left-side first terminal row which are attached firmly in this manner are fixed using solder. Note that, the shape of the upper portion 34*a* of the first connection terminal 34 illustrated in FIG. 5 and the shape of the upper portion 34*a* of the first connection terminal 34 illustrated in FIG. 6 are slightly different from each other. This difference is expedientially made in drafting of the drawings. In practice, all of the upper portions 34*a* of the first connection terminals 34 illustrated in each of the drawings attached to the present specification have an identical shape.

Figure 7:
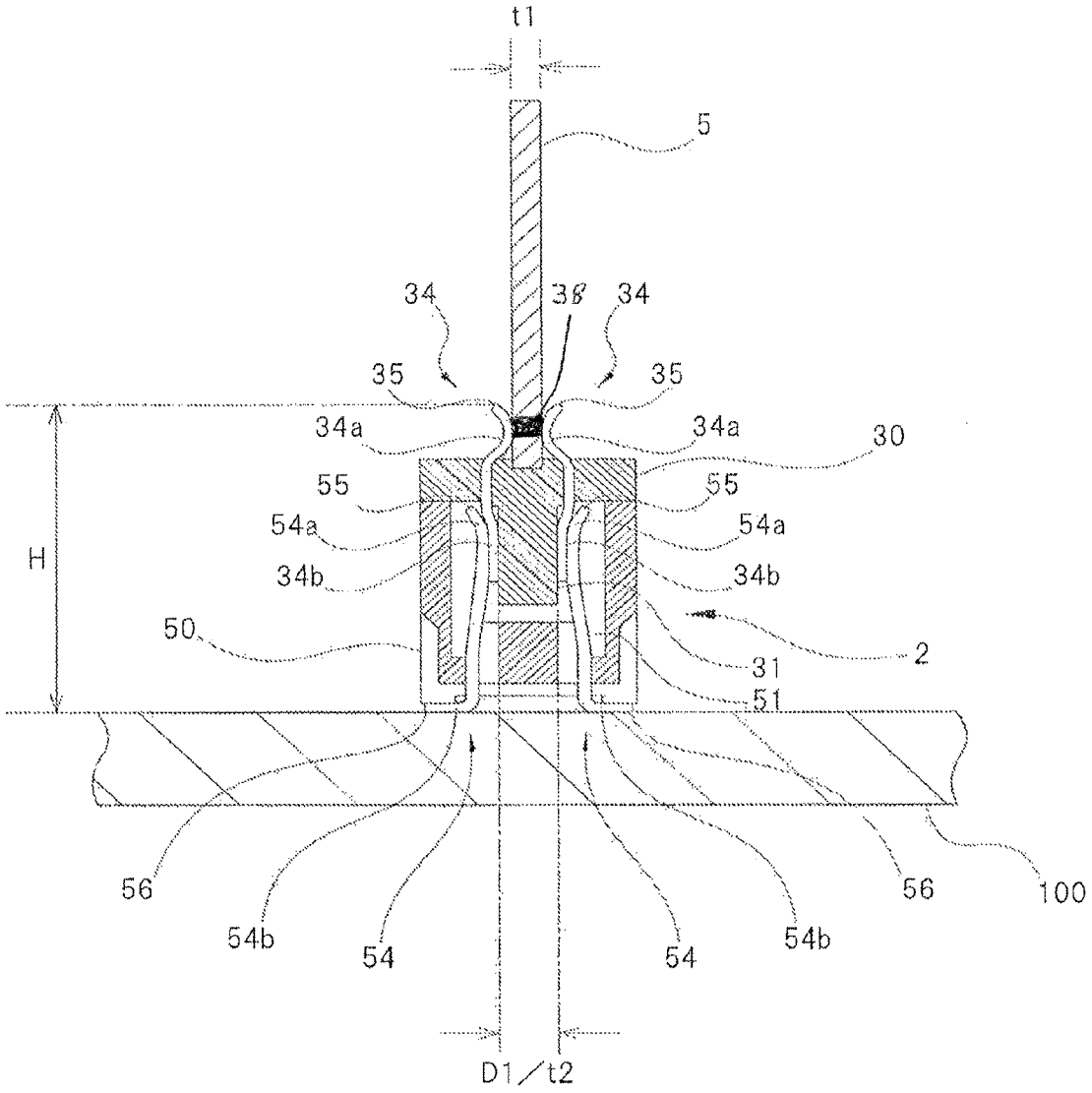
FIG. 7 is an enlarged perspective view illustrating a connection state of the plug connector and the receptacle connector.

As illustrated in FIG. 6, a thickness (t1) of the module substrate 5 is smaller than a thickness (t2) of the inserting convex portion 31 of the plug connector 30. The thickness (t1) of the module substrate 5 is preferably around one quarter or more and three quarters or less of the thickness (t2) of the inserting convex portion 31. More specifically, to maintain the strength of the module substrate 5 to the extent more than a certain strength, the thickness (t1) of the module substrate 5 is preferably larger than or equal to 0.25 mm. Meanwhile, to achieve a transmission speed of 25 Gbit/sec, the thickness (t1) of the module substrate 5 is preferably smaller than or equal to 0.75 mm. Note that, the thickness (t1) of the module substrate 5 is 0.5 mm and the thickness (t2) of the inserting convex portion 31 of the plug connector 30 is 1.0 mm in the present embodiment. As illustrated in FIG. 7, a plurality of through-holes 38 penetrating through the module substrate 5 are formed in the module substrate 5, and these through-holes form a conductive path that is a part of a signal transmission path. For example, the through-holes penetrating through the module substrate 5 form a part of the signal transmission path connecting the light-emitting element and the light-receiving element (not illustrated), which include a photoelectric conversion portion, to the connection pad 37. The total length of the through-holes penetrating through the module substrate 5 is the same as or the substantially same as the thickness (t1) of the module substrate 5. That is, the total length of the through-holes formed in the module substrate 5 in the present embodiment is about 0.5 mm, that is, about a half of the thickness (t2) of the inserting convex portion 31.

Moreover, a part of the signal transmission path may be formed by forming vias having the same conducting function as the through-holes described above in the module substrate 5, and electrically connecting one surface layer of the module substrate 5 and an inner layer of the module substrate 5 and/or the other surface layer of the module substrate 5 and the inner layer of the module substrate 5 through the vias. In other words, by the through-holes and or the vias, a conduction path may be formed in the thickness direction of the module substrate 5.

As illustrated in FIG. 5, in the present embodiment, a plurality of pad groups, each of which includes four connection pads 37, are arranged along one side of the module substrate 5. Among the four connection pads 37 included in each of the pad groups, outer two connection pads 37 are for grounding (G) and inner two connection pads 37 are for signaling (S). In other words, in each pad group, a grounding pad, a signaling pad, a grounding pad and a signaling pad are aligned in this order. Among the plurality of first connection terminals 34, the first connection terminal 34 in contact with the connection pad 37 for grounding is grounded, and differential signals are inputted to and outputted from the first connection terminal 34 in contact with the connection pad 37 for signaling. That is, one set of the first connection terminals 34 to and from which the differential signals are inputted and outputted are sandwiched by the other set of the first connection terminals 34 which are grounded. In the first place, the descriptions regarding the terminal arrangement described above are about an arrangement of terminals for high-speed signaling and not about an arrangement of terminals for low-speed signals (for example, for control signal) or an arrangement of terminals for powering.

Figure 4A:
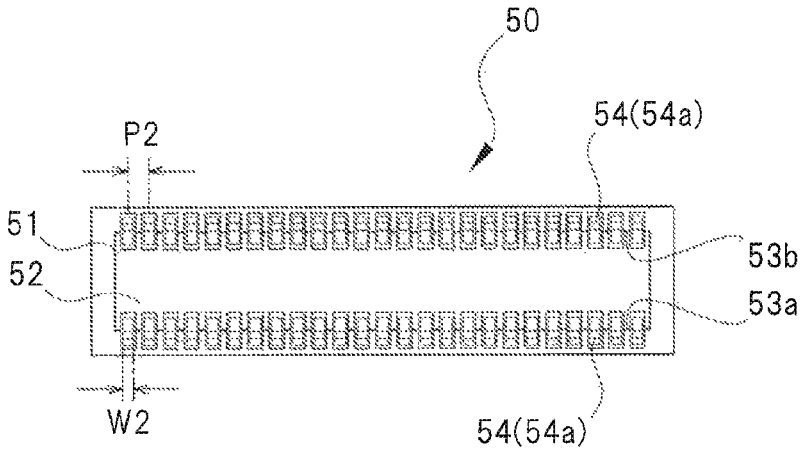
FIG. 4A is a plan view a receptacle connector.
Figure 4B:
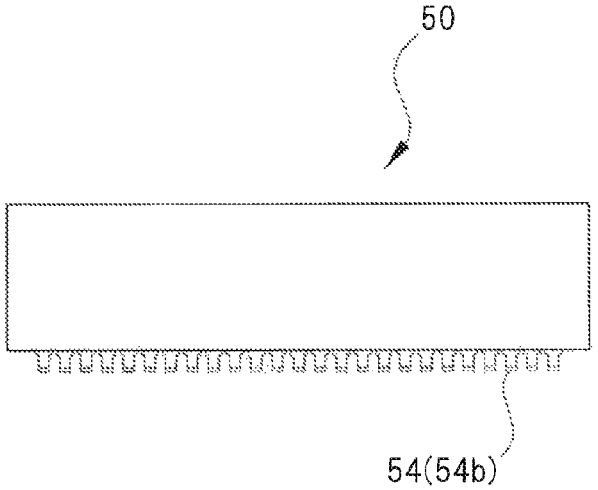
FIG. 4B is a front view of the receptacle connector.
Figure 4C:
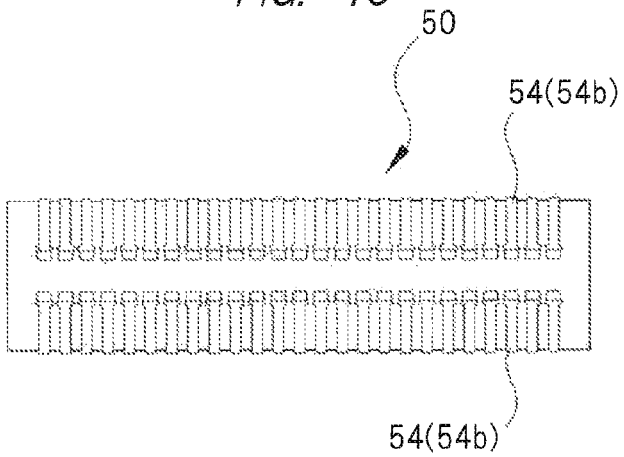
FIG. 4C is a bottom view of the receptacle connector.

As illustrated in FIGS. 4A to 4C, the receptacle connector is formed of a dielectric (synthetic resin in the present embodiment) and includes the inserting concave portion 51 into which the inserting convex portion 31 (FIG. 3B) of the plug connector 30 is inserted.

As illustrated in FIG. 4A, the inserting concave portion 51 has a bottom portion 52, and inner side surfaces 53*a* and 53*b* standing from an inner surface of the bottom portion. The inner side surfaces 53*a* and 53*b* stand from two longer sides opposing each other in the inner surface of the bottom portion. The inner side surfaces 53*a* and 53*b* are in parallel with each other and oppose each other. In each of the inner side surfaces 53*a* and 53*b*, a plurality of the second connection terminals are arranged in parallel with each other along a longitudinal direction of the inner side surfaces 53*a* and 53*b*. In other words, in each of the inner side surfaces 53*a* and 53*b* of the inserting concave portion 51, a terminal row including the plurality of second connection terminals 54 is formed. In the following description, the inner side surface 53*a* that is one side of the inserting concave portion 51 may be called "right inner side surface 53*a*", and the inner side surface 53*b* that is the other side of the inserting concave portion 51 may be called "left inner side surface 53*b*", as illustrated in FIG. 4. In addition, a terminal row formed in the right inner side surface 53*a* may be called "right-side second terminal row", and a terminal row formed in the left inner side surface 53*b* may be called "left-side second terminal row".

Each of the second connection terminals 54 forming the right-side second terminal row and the left-side second terminal row extends along the inserting direction and reaches to the top and bottom of the bottom portion 52 penetrating through the bottom portion 52. That is, while one part of the second connection terminal 54 in the longitudinal direction is protruded upwards from the bottom portion 52 (inside of the inserting concave portion 51), the other part of the second connection terminal 54 in the longitudinal direction is protruded downwards from the bottom portion 52 (outside of the inserting concave portion 51). Accordingly, in the following description, a part of the second connection terminal 54 in the longitudinal direction, which is protruded upwards from the bottom portion 52, may be called "upper portion 54*a*", and the other part of the second connection terminal 54 in the longitudinal direction, which is protruded downwards from the bottom portion 52, may be called "lower portion 54*b*".

As illustrated in FIG. 4A, the upper portion 54*a* of each of the second connection terminals 54 forming the right-side second terminal row and the upper portion 54*a* of each of the second connection terminals 54 forming the left-side second terminal row form a pair opposing each other. Meanwhile, as illustrated in FIG. 4C, the lower portion 54*b* of each of the second connection terminals 54 is bended outwards at substantially 90 degrees and extended along an outer surface of the bottom portion.

As illustrated in FIG. 5, a plurality of connection pads 57 are formed in the motherboard 100, and the lower portions 54*b* of each of the second connection terminals 54 bended as described above are stacked on a predetermined connection pad 57 and soldered.

In the present embodiment, a plurality of pad groups, each of which includes four connection pads 57, are arranged on the motherboard 100 in a linear manner. Among the four connection pads 57 included in each of the pad groups, outer two connection pads 57 are for grounding (G) and inner two connection pads 57 are for signaling (S). In other words, in each pad group, a grounding pad, a signaling pad, a grounding pad and a signaling pad are aligned in this order. Among the plurality of second connection terminals 54, the second connection terminal 54 soldered to the connection pad 57 for grounding is grounded, and differential signals are inputted to and outputted from the second connection terminal 54 soldered to the connection pad 57 for signaling. That is, one set of the second connection terminals 54 to and from which the differential signals are inputted and outputted are sandwiched by the other set of the second connection terminals 54 which are grounded.

As illustrated in FIG. 5, when the plug connector 30 is connected to the receptacle connector 50, a certain connection pad 37 on the module substrate 5 and a certain connection pad 57 on the motherboard 100 are connected via the first connection terminal 34 and the second connection terminals 54. More specifically, as illustrated in FIG. 7, when the inserting convex portion 31 of the plug connector 30 is inserted into the inserting concave portion 51 of the receptacle connector 50, the right-side first terminal row and the left-side first terminal row provided in the outer side surfaces 33*a* and 33*b* of the inserting convex portion 31 (FIG. 3C) are inserted between the right-side second terminal row and the left-side second terminal row provided in the inner side surfaces 53*a* and 53*b* of the inserting concave portion 51 (FIG. 4A). More specifically, the lower portions 34*b* of the pair of first connection terminals 34 are inserted between the upper portions 54*a* of the opposing second connection terminals 54. Then, the opposing second connection terminals 54 are elastically deformed such that the respective upper portions 54*a* are separated from each other. As a result, the upper portions 54*a* of the respective second connection terminals 54 are attached firmly to the lower portions 34*b* of the corresponding first connection terminals 34 by elastic resilience. According to the structure, the first connection terminals 34 and the second connection terminals 54 are electrically connected with high reliability.

That is, the connection pad 37 on the module substrate 5 (FIG. 5) and the connection pad 57 on the motherboard 100 (FIG. 5) are connected via the first connection terminals 34 and the second connection terminals 54. In other words, between the photoelectric conversion portion on the module substrate 5 and the semiconductor chip on the motherboard 100, a signal transmission path including the connectors 2 (first connection terminal 34 and second connection terminal 54) is formed. That is, a part of the signal transmission path between the photoelectric conversion portion on the module substrate 5 and the semiconductor chip on the motherboard 100 is formed with the connectors 2 (first connection terminal 34 and second connection terminal 54).

The plug connector 30 connected (inserted) to the receptacle connector 50 is fixed to the receptacle connector 50 by clips 60. As illustrated in FIG. 2, a pair of the clips 60 formed of a plate metal are attached on both sides in the width direction of the receptacle connector 50. A locking hole 61 is formed in each of the clips 60. Meanwhile, in both side surfaces of the frame 4 of the communication module 1, a locking protrusion 62 is provided. When the plug connector 30 is connected to the receptacle connector 50, that is, when an inserted length of the inserting convex portion inserted into the inserting concave portion 51 reaches a predetermined length, as illustrated in FIG. 1, the locking protrusion 62 is engaged with the locking hole 61. In this manner, the communication module 1 in which the plug connector is provided and the receptacle connector 50 are fixed. Note that the clip 60 formed of a plate metal is elastically deformable. Thus, when two clips 60 and 60 are expanded outwards such that they are separated from each other, the engagement of the locking hole 61 and the locking protrusion 62 is released, and the fixing of the communication module 1 and the receptacle connector 50 is also released.

Here, the second connection terminals 54 provided in the receptacle connector 50 have a straight-like shape. The straight-like shape means that, as illustrated in FIG. 7, an end portion 55 on the top side of the inserting direction is at a higher height in the same direction than any other parts; and also there is no part positioned at the same height in the inserting direction. For example, even when an end of a connection terminal in the inserting direction is at the highest position in the same direction, as a result of warping or bending of the connection terminal, when there are two or more parts positioned at the same height in the inserting direction in the connection terminal, the shape of the connection terminal is not straight.

In the present embodiment, in a state in which the plug connector 30 and the receptor connector 50 are being connected, a straight distance along the inserting direction, from the end portion 56 of the bottom side of the inserting direction of the second connection terminals 54 having a straight shape to the end portion 35 of the top side of the inserting direction of the first connection terminal 34 that is in contact with the second connection terminal 54, is preferable to be smaller than or equal to 6.0 mm. In other words, a height (H) from the end portion 56 of the bottom side of the inserting direction of the second connection terminal 54 to the end portion 35 of the top side of the inserting direction of the first connection terminals 34 is preferable to be smaller than or equal to 6.0 mm. In the present embodiment, the height (H) is 5.4 mm.

As described above, a part of the signal transmission path between the photoelectric conversion portion on the module substrate 5 and the semiconductor chip on the motherboard 100 is formed with the connectors 2 (first connection terminal 34 and second connection terminal 54). However, the part of the signal transmission path formed with the connectors 2 has bad transmission characteristics as compared to the other part of the signal transmission path formed with a wiring layer and through-holes on the module substrate 5 and the motherboard 100. For example, in the part of the signal transmission path formed with the connectors 2 (hereinafter, "connector portion"), it is difficult to completely align characteristic impedance and thus reflection of electric signals is likely to occur. Therefore, from the viewpoint of suppressing signal degradation and improving the transmission characteristics, it is preferable to make the length of the connector portion in the signal transmission path as short as possible. More specifically, the length of the connector portion in the signal transmission path is preferably to be set to one severalth of a wavelength of signals to be propagated in the signal transmission path at most. For example, a frequency of a basic wave of high-speed signals of 25 Gbit/sec is 12.5 GHz, and a wavelength of high-speed signals of 25 Gbit/sec is 24.0 mm. Meanwhile, in the present embodiment, the height (H) illustrated in FIG. 7 is 5.4 mm. In addition, the height (H) illustrated in FIG. 7 is a distance (height) from the end portion 56 of the bottom side of the inserting direction of the second connection terminal 54 to the end portion 35 of the top side of the inserting direction of the first connection terminal 34 that is in contact with the second connection terminal 54. That is, in the present embodiment, the length of the connector portion in the signal transmission path between the photoelectric conversion portion on the module substrate 5 and the semiconductor chip on the motherboard 100 is set to one quarter of a signal wavelength (24.0 mm). The above-described signal wavelength is a signal wavelength in vacuum and an actual signal wavelength (inside the connectors 2) is about a half of the numerical value described above. This is because the signal propagation speed (C1) in the transmission path is determined by, as expressed by the following equation, a dielectric constant 8 of the dielectric material that is a material of the connectors 2 (dielectric constant (∈) of crystal polymer generally used as material of connectors is around 4.0). A signal wavelength (λ) is determined by a signal propagation speed (C1).

$$C1=C/(\sqrt{\in})\quad C\text{: Light Speed (about 300,000 km/sec)}$$

$$C1=f\cdot\lambda\quad \in\text{: Dielectric Constant}$$

$$f\text{: Frequency}\quad \lambda\text{: Signal Wavelength}$$

Thus, even when the signal wavelength in vacuum is 24.0 mm, an actual signal wavelength, an actual signal wavelength upon propagating in the first connection terminals 34 and the second connection terminals 54, illustrated in FIG. 7, is about 12.0 mm. That is, the height (H) illustrated in FIG. 7 is set to one quarter in the relationship with a signal wavelength in vacuum. In a realistic relationship between the height (H) and the signal wavelength, the height (H) is set to a half. The inside of the connectors 2 is a composite structure of dielectric and air (having the almost same dielectric constant as vacuum). Thus, an outline of the concept is described in the above description, and an effective dielectric constant (∈) may be considered to be even smaller. In any case, in the present embodiment, the length of the connector portion in the signal transmission paths is set to one severalth of a wavelength of signals propagated in the signal transmission path, thereby reducing signal degradation.

In addition, as illustrated in FIG. 6, in the present embodiment, the thickness (t1) of the module substrate 5 is smaller than or equal to a half of the thickness (t2) of the inserting convex portion 31. That is, a total length of the through-holes on the module substrate 5, which forms the other part of a signal transmission path between the photoelectric converting portion on the module substrate 5 and the semiconductor chip on the motherboard 100, is shorter than before. Thus, signal degradation in the electric transmission on the module substrate 5 is particularly reduced.

Meanwhile, the thickness (t2) of the inserting convex portion 31 of the plug connector 30 illustrated in FIG. 6 can be optionally changed in accordance with the width of the inserting concave portion 51 of the receptacle connector 50 illustrated in FIG. 2. In addition, the length of a signal transmission path is not increased or decreased depending on increase and decrease of the thickness (t2) of the inserting convex portion 31 illustrated in FIG. 6. Thus, when the width of the inserting concave portion 51 of the receptacle connector 50 is defined by a standard or else, the thickness (t2) of the inserting convex portion 31 of the plug connector 30 can be set.

Further, a crosstalk prevention effect between the right-side first terminal row and the left-side first terminal row can be improved by increasing the thickness (t2) of the inserting convex portion 31 of the plug connector 30. More specifically, from the viewpoint of preventing crosstalk of electric signals, it is preferable that a gap between the right-side first terminal row and the left-side first terminal row is sufficiently wide with respect to a gap between two neighboring first connection terminals 34 in the terminal rows. In addition, when the thickness (t2) of the inserting convex portion 31 illustrated in FIG. 6 is increased, it is needless to say that the gap between the right-side first terminal row and the left-side first terminal row is enlarged. In this regard, in the present embodiment, a gap (D1) between the first connection terminal 34 formed in the right outer side surface 33*a* and the first connection terminal 34 formed in the left outer side surface 33*b* illustrated in FIG. 3C is about 1.0 mm. In other words, the gap (D1) between the right-side first terminal row and the left-side first terminal row is about 1.0 mm. On the other hand, a gap (D2) between the two neighboring first connection terminals 34 in the right-side first terminal row or the left-side first terminal row is about 0.25 mm. That is, the gap (D1) is more than four times the gap (D2) and thus crosstalk can be sufficiently prevented. Note that, the gap (D1) will be more clearly understood by referring to FIG. 7. That is, the gap between the part of opposing first connection terminals 34 with the inserting convex portion 31 interposed therebetween and the gap between the pair of second connection terminals 54 differ depending on places (inserting direction), that is, the gap is not constant. Meanwhile, from the view of preventing crosstalk, a minimum gap between the pair of opposing first connection terminals 34 is the most important. As illustrated in FIG. 7, the gap (D1) corresponds to the minimum gap between the pair of opposing first connection terminals 34 with the inserting convex portion 31 interposed therebetween.

The gap (D2) illustrated in FIGS. 3A to 3C is not limited to 0.25 mm. For example, the gap (D2) can be changed if needed in a range of 0.20 mm to 0.30 mm. The gap (D1) can be changed if needed in accordance with a change of the gap (D2).

In addition, an arrangement pitch (P1) of the first connection terminals 34 illustrated in FIG. 3B is preferably 0.45 mm or more and 0.55 mm or less, and it is about 0.50 mm in the present embodiment. In the same manner, an arrangement pitch (P2) of the second connection terminals 54 illustrated in FIG. 4A is preferably 0.45 mm or more and 0.55 mm or less, and it is about 0.50 mm in the present embodiment. Note that "arrangement pitch" means a distance between the centers of neighboring connection terminals.

In addition, a width (W1) of the first connection terminals 34 illustrated in FIG. 3B and a width (W2) of the second connection terminals 54 illustrated in FIG. 4A are preferably 0.15 mm or more and 0.30 mm or less.

The numerical values related to the arrangement pitch, the gap between connection terminals and the width of connection terminals are particularly preferable values in achieving a transmission speed of 25 Gbit/sec or more, a desired number of channels, a highly accurate control of impedance, and reduction of manufacturing cost, etc.

Note that an effective engagement length of the plug connector 30 and the receptacle connector 50 in the present embodiment is about 0.7 mm.

The present invention having these features as described above can be used not only in optical communication modules and optical connectors, but also in electric communication modules and electric connectors. Particularly, the present invention is suitable to be applied in electric communication modules and electric connectors which are used in super computers, data centers, etc., requiring high reliability and very high speed. Note that, when the present invention is applied in electric communication modules and electric connectors, the optical fiber 3 illustrated in FIGS. 1 and 2 is replaced with a cable for electric signal transmission.

The present invention is not limited to the foregoing embodiments and various modifications and alterations can be made within the scope of the present invention. While it has been described that the speed of digital signals inputted to and outputted from semiconductor chips and communication modules of the next generation will be 25 Gbit/sec, this signal speed is merely an example of an expected signal speed. The present invention can be expected to have a significant effect in high-speed transmission whose the transmission speed is more than or equal to 20 Gbit/sec.

What is claimed is:

1. A communication module connector comprising:

a plug connector provided in a communication module; and a receptacle connector provided in a substrate to which the communication module is connected, wherein the plug connector has an inserting convex portion, a flange portion, and a plurality of first connection terminals, the inserting convex portion being connected to a module substrate included in the communication module;

the receptacle connector has an inserting concave portion into which the inserting convex portion is inserted;

the plurality of first connection terminals are arranged in two outer side surfaces in parallel with each other, of the inserting convex portion;

a plurality of second connection terminals in contact with the first connection terminals are arranged in two inner side surfaces in parallel with each other, of the inserting concave portion;

the flange portion is provided in an end portion of the inserting convex portion, and the end portion is provided on an opposite side to an inserting direction with respect to the receptacle connector;

the inserting convex portion has two outer side surfaces in parallel with each other;

the plurality of first connection terminals are arranged on the two outer side surfaces;

each of the plurality of first connection terminals extends along the inserting direction;

an upper part of each of the plurality of first connection terminals in the inserting direction protrudes from the flange portion to an inserting direction side, and a lower part of each of the plurality of first connection terminals in the inserting direction protrudes from the flange portion to the opposite direction of the inserting direction; and a gap, between the upper part of the first connection terminals arranged on a first outer side surface of the inserting convex portion and the upper part of the first connection terminals arranged on a second outer side surface of the inserting convex portion, is one quarter or more and three quarters or less of a thickness of the inserting convex portion.

2. The communication module connector according to claim 1, wherein a thickness of the module substrate is 0.25 mm or more and 0.75 mm or less.

3. A communication module that is connected to a substrate comprising:

a module substrate;

a frame in which the module substrate is accommodated; and a plug connector connected to a receptacle connector provided in the substrate, wherein the plug connector has an inserting convex portion, a flange portion, and a plurality of first connection terminals, the inserting convex portion being inserted into an inserting concave portion included in the receptacle connector and being connected to the module substrate;

a plurality of first connection terminals are arranged in two outer side surfaces of the inserting convex portion, the two outer side surfaces in parallel with each other, the plurality of first connection terminals in contact with a plurality of second connection terminals which are arranged in two inner side surfaces of the inserting concave portion, the two inner side surfaces in parallel with each other;

a thickness of the module substrate is one quarter or more and three quarters or less of a thickness of the inserting convex portion;

the flange portion is provided in an end portion of the inserting convex portion, and the end portion is provided on an opposite side to an inserting direction with respect to the receptacle connector;

the inserting convex portion has two outer side surfaces in parallel with each other;

the plurality of first connection terminals are arranged on the two outer side surfaces;

each of the plurality of first connection terminals extends along the inserting direction;

an upper part of each of the plurality of first connection terminals in the inserting direction protrudes from the flange portion to an inserting direction side, and a lower part of each of the plurality of first connection terminals in the inserting direction protrudes from the flange portion to the opposite direction of the inserting direction;

a gap, between the upper part of the first connection terminals arranged on a first outer side surface of the inserting convex portion and the upper part of the first connection terminals arranged on a second outer side surface of the inserting convex portion, is one quarter or more and three quarters or less of a thickness of the inserting convex portion;

a plurality of connection pads are formed on both surfaces of a verge of the module substrate; and the connection pad and a part of the first connection terminals are in contact with each other and electrically connected to each other.

4. The communication module according to claim 3, wherein a thickness of the module substrate is 0.25 mm or more and 0.75 mm or less.

5. The communication module according to claim 3, wherein a conductive path that forms a part of a signal transmission path is provided in the module substrate; and a length of the conductive path in a thickness direction of the module substrate is one quarter or more and three quarters or less of a thickness of the inserting convex portion.

6. The communication module according to claim 4, wherein a conductive path that forms a part of a signal transmission path is provided in the module substrate; and a length of the conductive path in a thickness direction of the module substrate is one quarter or more and three quarters or less of a thickness of the inserting convex portion.

* * * * *